US012343777B2

(12) United States Patent
Marchal et al.

(10) Patent No.: US 12,343,777 B2
(45) Date of Patent: Jul. 1, 2025

(54) METHOD FOR MODELLING THE BEHAVIOUR OF A CIRCULAR ROLLING MILL

(71) Applicant: SAFRAN AIRCRAFT ENGINES, Paris (FR)

(72) Inventors: Edouard Frédéric Christian Claude Marchal, Moissy-Cramayel (FR); Julien Jean Edmond Schwartz, Moissy-Cramayel (FR); Patrice André Modeste Lasne, Valbonne (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 234 days.

(21) Appl. No.: 18/028,296

(22) PCT Filed: Sep. 20, 2021

(86) PCT No.: PCT/FR2021/051603
§ 371 (c)(1),
(2) Date: Mar. 24, 2023

(87) PCT Pub. No.: WO2022/064127
PCT Pub. Date: Mar. 31, 2022

(65) Prior Publication Data

US 2023/0372988 A1 Nov. 23, 2023

(30) Foreign Application Priority Data

Sep. 25, 2020 (FR) ..... 2009788

(51) Int. Cl.
*B21B 37/00* (2006.01)
*B21B 1/18* (2006.01)
*B21H 1/06* (2006.01)

(52) U.S. Cl.
CPC ..... *B21B 37/00* (2013.01); *B21B 1/18* (2013.01)

(58) Field of Classification Search
CPC ..... B21B 37/00; B21B 1/18; B21H 1/06
See application file for complete search history.

(56) References Cited

U.S. PATENT DOCUMENTS 4,339,937 A * 7/1982 Strugala ..... B21H 1/06 72/110
2002/0045965 A1* 4/2002 Takizawa ..... G06F 30/23 700/98

FOREIGN PATENT DOCUMENTS

CN 106583609 A * 4/2017
CN 111069486 A 4/2020
(Continued)

OTHER PUBLICATIONS

English translate (CN106583609A), retrieved date Jan. 1, 2025.*
(Continued)

*Primary Examiner* — Mohammed S. Alawadi
(74) *Attorney, Agent, or Firm* — Sughrue Mion, PLLC

(57) ABSTRACT

The invention relates to a method for modelling the behaviour of a circular rolling mill (1) intended for rolling a cylindrical component on the basis of a setpoint, the circular rolling mill comprising at least one tapered roller (3) configured to effect a translational movement in a first direction (Y), and a mandrel (2), configured to effect a translational movement in a second direction (X), the setpoint comprising a setpoint for the rate of increase of an outside diameter of said cylindrical component as a function of said external diameter, and a setpoint for the height of the cylindrical component in the first direction as a function of a thickness of the cylindrical component in the second direction.

5 Claims, 10 Drawing Sheets

(56) References Cited

FOREIGN PATENT DOCUMENTS

| | | | |
|---|---|---|---|
| JP | 54-155977 | A | 12/1979 |
| KR | 10-2011-0090423 | A | 8/2011 |

OTHER PUBLICATIONS

Search Report issued Jun. 9, 2021 in French Application No. 2009788.

International Search Report issued Jan. 20, 2022 in International Application No. PCT/FR2021/051603.

"Optimum Design Method For Ring Rolling Schedule", Thomson Scientific, London, GB, Clarivate Analytics, 2017, Accession No. 2011-L48936, Retrieved from: Database WPI (online) XP002803159 (1 page total).

"Method Ensure Stabilised Roll Ring Wall Based Thick Differ Control Feed Speed Core Process Accord Curve", Thomson Scientific, London, GB, Clarivate Analytics, 2017, Accession No. 2020-381051, Retrieved from: Database WPI (online) XP002803160 (1 page total).

S. Puller et al., "Prozessauslegung Beim Ringwalzen", Umformtechnik, Meisenbach, Bamberg, DE, Mar. 1, 2002, vol. 36, No. 1, pp. 42-43 (2 pages total).

E. Doege et al., 'Simulation Des Ringwalzens Die Rechnergestuetzte Auslegung Des Ringwalzprozesses Hilft Beim Konstruieren, Werkstattstechnik, Springer Verlag, Berlin, DE, Jul. 1, 1993, vol. 83, No. 7/8, pp. 42-45 (4 pages total).

* cited by examiner

METHOD FOR MODELLING THE BEHAVIOUR OF A CIRCULAR ROLLING MILL

CROSS REFERENCE TO RELATED APPLICATIONS

This application is a National Stage of International Application No. PCT/FR2021/051603 filed Sep. 20, 2021, claiming priority based on French Patent Application No. 2009788 filed Sep. 25, 2020.

FIELD OF THE INVENTION

This invention relates to the field of modelling of casting methods, and in particular the modeling of circular rolling methods.

PRIOR ART

At this time the modeling of casting methods is a significant issue in industry since this modeling makes it possible to design new casting sequences or to optimize existing sequences. A casting sequence is the set of forming operations making it possible, using specific tools, to make a bar section into a defect-free rough of the desired shape. A reliable and realistic model of all these operations, and in particular of the behavior of the tools and the bar section makes it possible to reduce the design time of a new casting sequence, since it also reduces the number of parts that must be produced to validate the new sequence.

Casting methods with a hydraulic press, or more generally vertical casting machines, are easy to model overall since the control principle of the press is simple. Specifically, there is only one movement of translation of the press during the casting. However, these casting methods are not very suited to the production of rings or bushes without welding. To allow for optimal use of the material, a circular rolling method is used to produce such parts.

In the case of circular rolling, the modeling of the behavior of the tools is complicated to implement, since it is necessary to take into account, in a synchronized manner, the simultaneous movements of translation and rotation of different tools. Similarly, the movements of the different tools entail several simultaneous changes in parameters of the bar section, which must be controlled. As a reminder, the principal of a circular rolling method is generally to reduce the cross-section and height of the bar section to increase its diameter in a controlled manner.

To model this type of method, it is necessary to control the displacement of all the tools constituting the circular rolling mill. In general, the tool commands are given as input to a control system of the roller by an operator, and depend on the part being laminated. When the operator wishes to laminate a new part, he must beforehand determine the input data, which are not only the final dimensions of the part to be obtained, but the joint variation in these dimensions.

The rolling method can be digitally modelled by finite element computations not taking into account the adaptative operation of the tools of the rolling mill managed by the control system.

In this case, it is general necessary to machine at least one part to check the quality of the casting sequence and retrieve the capture data, in particular the tool displacement data and the data concerning the forces exerted on the tools during the rolling of the part, to incorporate them into the modeling of the rolling method.

However, this practice does have several limitations. Firstly, it is necessary to produce a part to make a model, which is time—consuming and incurs a significant cost. Secondly, each model made is only relevant in relation to a particular shape of part from a particular tool, and it is therefore impossible to predict the behavior of the different tools if the blank of the cylindrical rough to be produced is different. Finally, such models are complicated to turn into data, since there is a need to rework the captures.

Finite element computation models exist which take into account the adaptative operation of the tools of the rolling mill managed by the control system.

At this time, machine servo-assistance models exist which integrate computer codes such as Simufact. However, the models used do not take into account the mechanical aspects of the circular rolling mill 1. The modelling predictions thus have low accuracy, and it is necessary to cast real parts to validate new casting sequences. Typically, existing models can greatly underestimate the duration of the casting method, for example by 10%. Existing models can also simulate radial and axial forces $F_{cone}$ not representative of reality.

OVERVIEW OF THE INVENTION

An aim of the invention is to remedy, at least in part, the aforementioned drawbacks, proposing a modelling method taking into account the behavior of all the movable tools of a circular rolling mill, and their interactions, making it possible to determine casting sequences reliably and quickly.

This aim is achieved by this invention owing to a method for modeling the behavior of a circular rolling mill intended to roll a cylindrical part based on a setpoint, the circular rolling mill comprising at least one tapered roller, configured to have a movement of translation along a first direction, and a mandrel, configured to have a movement of translation along a second direction, the setpoint comprising a setpoint of the speed of increase of an outer diameter of said cylindrical part as a function of said outer diameter, and a setpoint for the height of the cylindrical part along the first direction as a function of a thickness of the cylindrical part along the second direction, said method comprising the steps of: E1—obtaining a first set of parameters characteristic of the behavior of the circular rolling mill by means of a control formula connecting a translation speed of the mandrel along the second direction of translation to the speed of increase of the outer diameter and a function of the setpoint; E2—Finite-element computation of a value of the force exerted on the tapered roller based on the first set of parameters; E3—Comparing the computed value of the force exerted on the tapered roller with at least one threshold force value permissible by the circular rolling mill, and if the value of the force exerted on the tapered roller is greater than the permissible force threshold value, obtaining a second set of parameters, such that the speed-of-increase setpoint is not observed, correcting the second set of parameters to obtain a third set of parameters; if the computed value of the force exerted on the tapered roller is less than the permissible force threshold value, correcting the first set of parameters by taking into account the stiffness of the mandrel to obtain a third set of parameters; said third set of parameters being characteristic of the behavior of the circular rolling mill for the given setpoint. Other features, aims and advantages of the invention will become apparent from the following description, which is purely illustrative and non-limiting, and which must be read with reference to the appended drawings wherein:

the first set of parameters obtained by the control formula comprises a speed $\dot{h}$ of displacement of the tapered roller and a speed $\dot{s}$ of translation of the mandrel;

the control formula is given by:

$$\dot{s} = \frac{s}{D - 2.s + \frac{\dot{h}}{\dot{s}}(D - s).\frac{s}{h}}\dot{D}$$

with s the position of the mandrel, $\dot{s}$ the speed of translation of the mandrel, and $\dot{D}$ to the speed of increase of the outer diameter D of the part to be rolled;

during the comparing step E3, the at least one permissible force threshold value depends on the outer diameter of the cylindrical part;

during the correcting step, the deformation of a cage of the mandrel, modelled as a spring of stiffness constant k is taken into account, such that the third set of parameters is obtained by an offset of at least one characteristic parameter of the behavior of the mandrel of the circular rolling mill.

DESCRIPTION OF THE FIGURES

Other features, aims and advantages of the invention will become apparent from the following description, which is purely illustrative and non-limiting, and which must be read with reference to the appended drawings on which.

Only the elements necessary to the understanding of the invention have been represented. To simplify the reading of the drawings, similar elements bear identical reference numbers on all the figures.

DETAILED DESCRIPTION OF THE INVENTION

Figure 1:
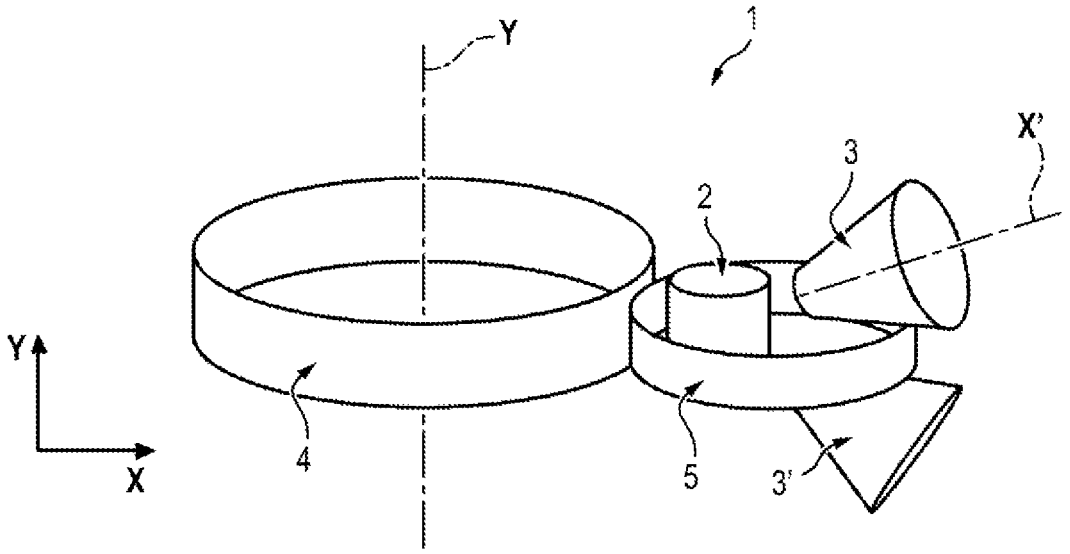
FIG. 1 schematically illustrates a circular rolling mill allowing the rolling of a cylindrical part.
Figure 2A:
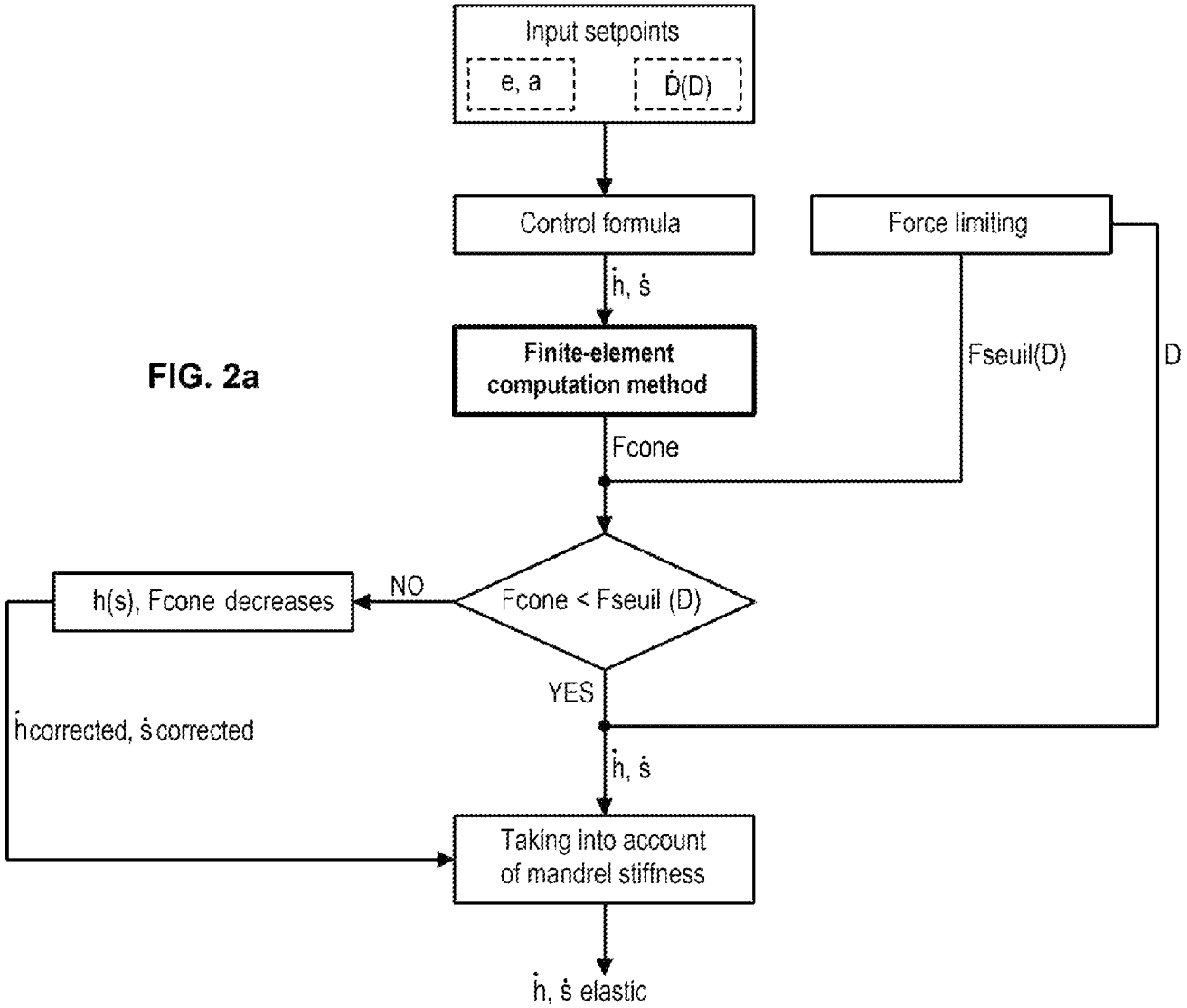
FIGS. 2*a* and 2*b* schematically illustrate the steps of a method for modeling the behavior of a circular rolling mill according to the invention.
Figure 2B:
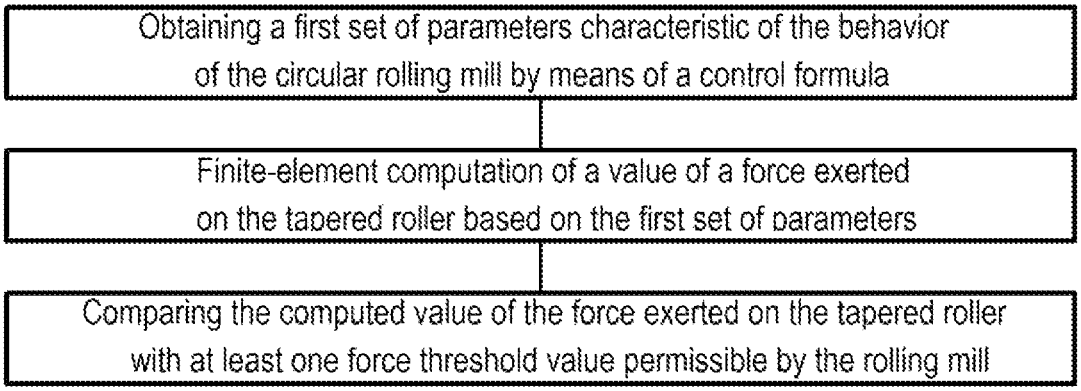

FIG. 1 schematically illustrates moving tools of a system for producing a cylindrical part known as a ring 5 during a circular rolling method illustrated in FIGS. 2*a* and 2*b*. The circular rolling mill 1 comprises at least one tapered roller 3, in translation along a first direction Y, and in rotation along a second roller direction X'. In the exemplary embodiment illustrated, the circular rolling mill 1 comprises an upper tapered roller 3 and a lower tapered roller 3'.

The circular rolling mill comprises an drive cylinder 4 in rotation about an axis tangent to the first direction Y, substantially vertical. The rotation speed of the drive cylinder 4 is controlled by a control unit 10, schematically illustrated in FIG. 5.

The rolling mill 1 comprises another cylindrical tool known as a mandrel 2, also in rotation about an axis along the first direction Y. The mandrel 2 can translate along a second direction X, substantially orthogonal to the first direction Y. The movement of translation and the movement of rotation of the mandrel 2 are controlled by the control unit 10.

Figure 3:
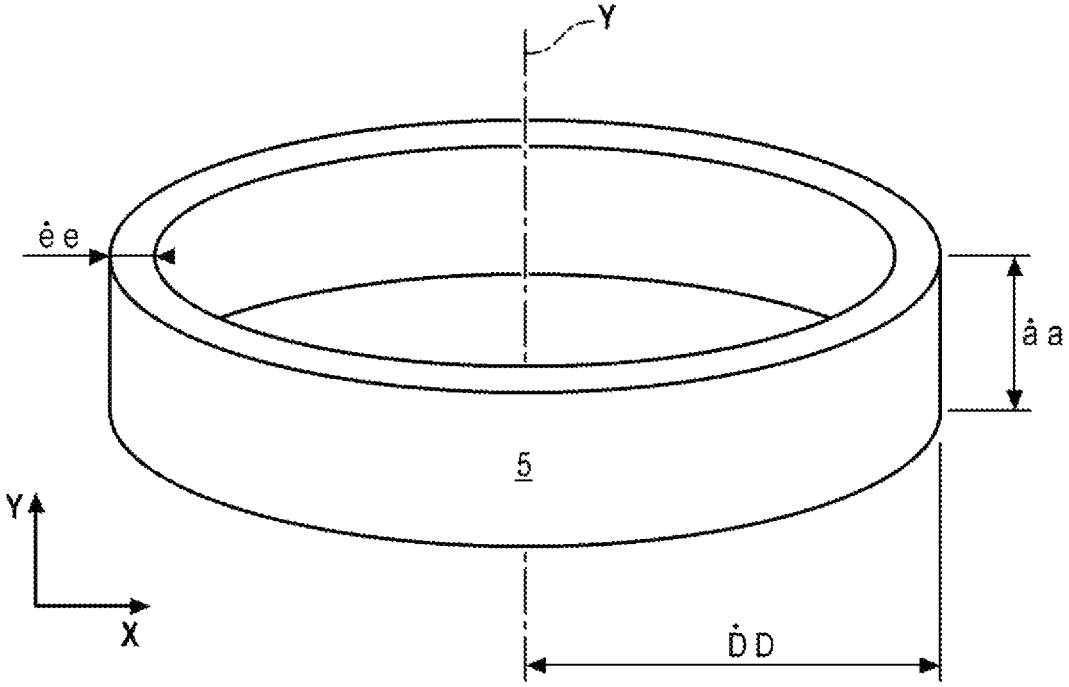
FIG. 3 schematically illustrates a cylindrical part that can be obtained by a circular rolling method.

FIG. 3 illustrates an example of a cylindrical ring 5 which may be obtained by rolling a bar section with the circular rolling mill 1. To form a ring 5 having a height a along the first direction Y and a thickness e and an outer diameter D along the second direction X, an operator may place the ring 5 under the at least one tapered roller 3 and between the mandrel 2 and the drive cylinder 4.

A movement of rotation of the tapered roller 3 simultaneous with a movement of translation of the tapered roller 3 makes it possible to vary the height a of the ring 5. In a related manner, movements of rotation of the drive cylinder 4 and of the mandrel 2, simultaneous with a movement of translation of the mandrel 2, make it possible to vary the thickness e of the ring.

At the same time the set of tool movements modifies the outer or external diameter D of the ring 5.

To attain the desired dimensions of the ring 5, it is advisable to give input setpoints as input to the control unit 10 (also known as the control system 10) of the circular rolling mill 1. The input setpoints comprise at least the desired dimensions of the cylindrical ring 5 to be rolled. Preferably, the input setpoints also comprise the laws of variation of the dimensions of the ring 5.

In an exemplary embodiment, the setpoint comprises a setpoint of the speed of increase $\dot{D}(D)$ of the outer diameter of the cylindrical ring 5 as a function of the outer diameter D.

Figure 4:
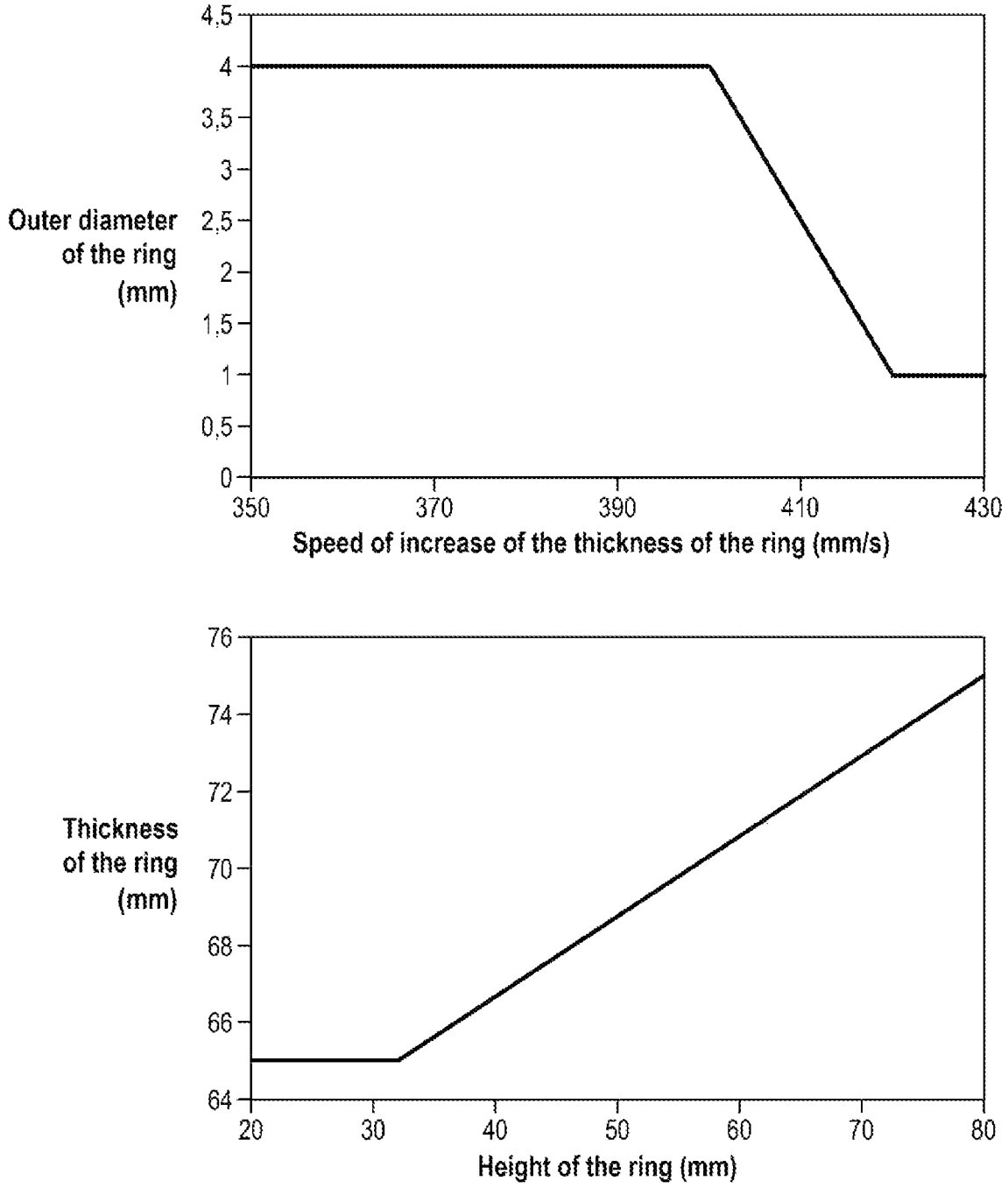
FIG. 4 illustrates examples of input setpoints of a circular rolling mill.

The setpoint may comprise a setpoint of height a(e) of the cylindrical ring 5 along the first direction Y as a function of the thickness e of the ring 5 along the second direction X. An example of such input setpoints is illustrated in FIG. 4.

Figure 5:
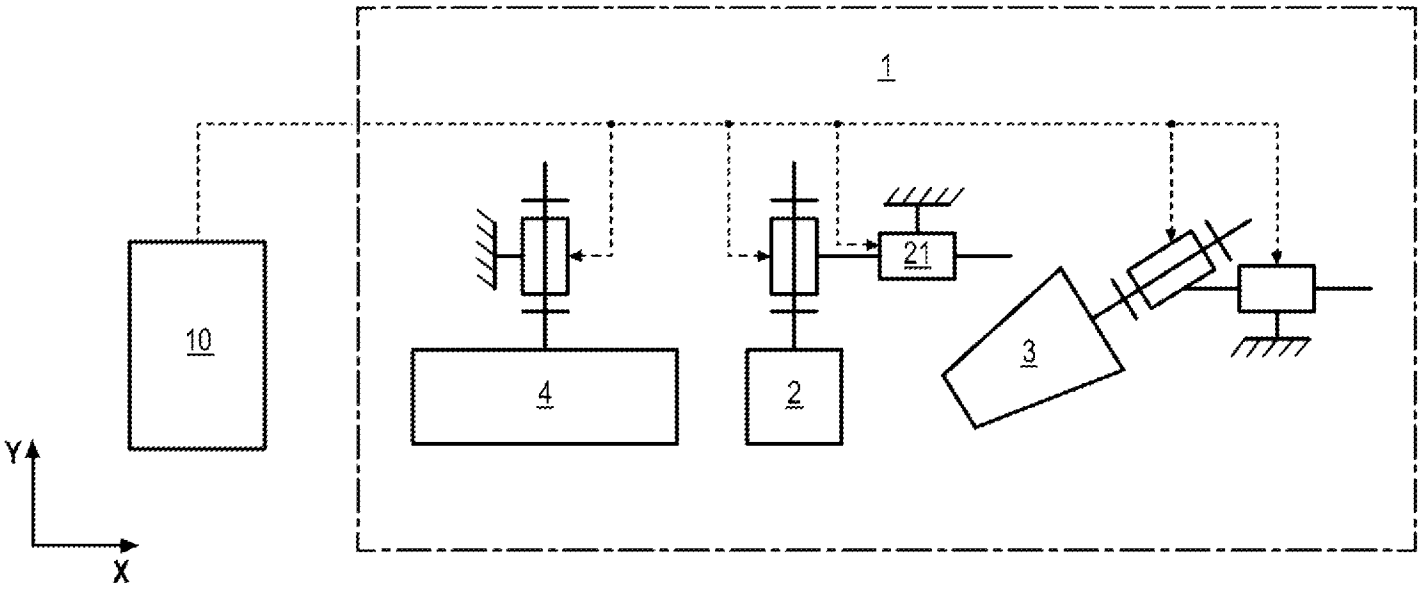
FIG. 5 schematically illustrates a system for controlling the movement of movable tools of the circular rolling mill of FIG. 1.

Based on the setpoints given as input to the control unit 10, the control unit 10 can control the movements of translation and rotation of the moving tools 2, 3, 4 of the rolling mill 1, as schematically illustrated in FIG. 5. Each casting sequence is associated with a particular setpoint. In particular, the circular rolling method stops once the desired outer diameter Dcible is achieved.

A first step E1 of the method for modelling the behavior of the circular rolling mill 1 is to determine a control formula, making it possible to link the input setpoint to at least one movement of a movable tool 2,3 of the roller 1. The control formula makes it possible to obtain a first set of parameters characteristic of the behavior of the circular rolling mill 1.

Preferably, it is a questioning of determining a control formula making it possible to link the input setpoint to all the movements of the movable tools 2,3 of the rolling mill 1.

In an exemplary embodiment, it is a question of connecting the speed of increase to $\dot{D}$ of the outer diameter D of the ring 5 to be rolled, associated with a particular casting sequence, at the speed of increase $\dot{e}$ of the thickness s of the ring 5 along the second direction X. The speed of increase $\dot{e}$ of the thickness e is directly linked to the movement of translation of the mandrel 2 along the second direction X and therefore to the translation speed of the mandrel.

Preferably, the relationship between the speed of increase to of the outer diameter D and the speed of increase 6 of the thickness e also depends on the other parameters of the ring 5, i.e. its height a, its outer diameter D and its thickness e.

To determine the control formula describing the different movements of the rolling mill 1, it is possible to study the principle of the servo-assistance loop of the rolling mill 1 which makes it possible to manage all the displacements of the movable tools 2,3,4 based on the setpoints entered by the operator.

In an exemplary embodiment, the control formula which has been identified to reproduce a part of the behavior of the rolling machine 1 along with the main setpoints input by the operator into the control unit 10 of the rolling mill 1 is given by:

$$\dot{s} = \frac{s}{D - 2.s + \frac{\dot{h}}{\dot{s}}(D - s).\frac{s}{h}}\dot{D}$$

with s the position of the mandrel directly related to the thickness e of the ring, $\dot{s}$ the speed of translation of the mandrel directly linked to the speed of increase $\dot{e}$ of the thickness e of the ring, h the position of the tapered roller, and $\dot{h}$ the speed of displacement of the tapered roller $\dot{h}$.

This non-linear control formula makes it possible to obtain a first speed of translation of the mandrel $\dot{s}$ of the theoretical thickness s, observing the input setpoints, as illustrated in FIG. 4.

It is also possible to link the speed of increase $\dot{D}$ to of the outer diameter D of the ring 5 to be rolled, to the speed of increase $\dot{a}$ of the height a of the ring 5 along the first direction Y.

Preferably, the relationship between the speed of increase $\dot{D}$ of the outer diameter D and the speed of increase $\dot{h}$ of the position h also depends on the other parameters of the ring 5, i.e. its height a, its outer diameter D and its thickness e.

The control formula used to obtain the first set of parameters characteristic of the behavior of the circular rolling mill 1 can be integrated into a finite element computation code. In an exemplary embodiment, it can be integrated into the Forge computer code by the editor of the Transvalor computation code.

Finite element computation code makes it possible to model the rolling method and in particular to compute a force $F_{cone}$ exerted by the tapered roller 3 on the ring 5 during a rolling method as a function of the first set of parameters.

To improve the control model previously obtained, mechanical features of the circular rolling mill 1 can be taken into account. In particular, it is possible to incorporate into the modeling a first mechanical model expressing a limitation of force on the tapered roller 3, and a second mechanical model translating the elasticity of the mandrel 2.

It is also necessary to manage the interaction of these two mechanical models with the model of the servo-assistance loop of the circular rolling. Finally, it has been necessary to produce hypotheses consistent with the circular rolling method to make the models interact with one another. This makes it possible to obtain a final control model representative of reality.

Force Limitation Incorporated into the Tapered Roller 3

To avoid damaging the roller 1, it is necessary for the force $F_{cone}$ exerted on the tapered roller 3 to not exceed a threshold value $F_{seuil}$. In an exemplary embodiment, the threshold value $F_{seuil}$ depends on the outer diameter D of the ring 5 being rolled. For example, the threshold value $F_{seuil}$ (D) can depend on the position along the second direction X of a point of the outer border of diameter D of the ring 5, in contact with a surface of the tapered roller 3.

Figure 6:
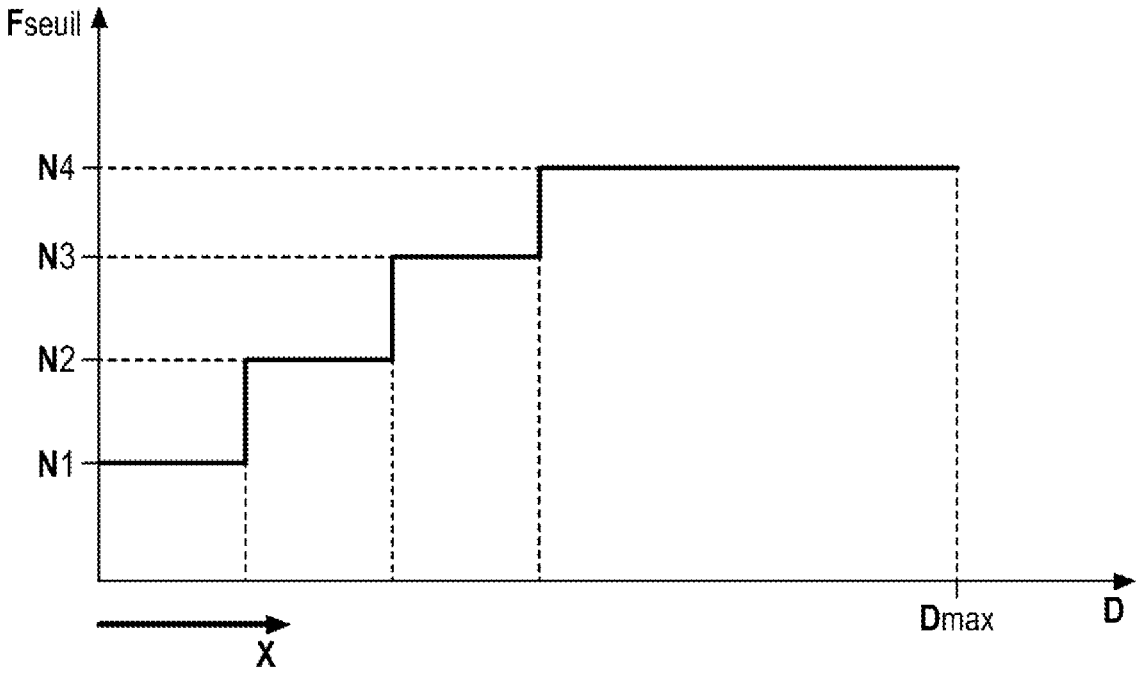
FIG. 6 illustrates different bearings defined by threshold force values permissible by a tapered roller of the rolling mill.

FIG. 6 illustrates an exemplary embodiment in which four threshold force values are defined $F_{seuil}$(D)={N1,N2,N3, N4}, defining four force limiting levels associated with three different thresholds of outer diameter D. The force threshold values depend on the type of rolling mill 1. For example, one may have N1=50 tons, N2=100 tons, N3=150 tons and N4=200 tons. Dmax corresponds to the maximum outer diameter which can be rolled. Dmax is preferably less than the axial dimension of the tapered roller 3 along the second direction X.

To manage the interaction of this first mechanical model with the model of the servo-assistance loop of the control formula of the circular rolling mill 1, two different situations may be defined.

Preferably, the first mechanical model is involved when the radial force $F_{cone}$ of the tapered roller 3 exceeds the threshold value $F_{seuil}$.

The modeling method comprises a step E3 of comparing the computed value of the force $F_{cone}$ exerted on the tapered roller 3 with the force threshold value $F_{seuil}$ permissible by the rolling mill 1.

If the value of the force $F_{cone}$ exerted on the tapered roller is greater than the permissible threshold value $F_{seuil}$, a second set of parameters is obtained, corresponding to the first set of parameters corrected.

During the force limiting, the control formula, for example one of the control formulae presented previously, is no longer applied. A constant force is applied by the tapered roller 3 to the ring 5. The first mechanical model will thus modify the displacement of the tapered roller 3, to ensure the maximum permissible force. Since the force applied to the first mechanical model is reduced in relation to the theoretical force computed by the finite element computation code, this will cause a slowdown in the speed of increase $\dot{D}$ to of the outer diameter D.

In an exemplary embodiment, the second set of parameters is computed by a control formula following only the height input setpoints h(s) of the ring 5 along the first direction Y as a function of the thickness s of the ring 5 along the second direction X, such that the speed of increase $\dot{D}$ to setpoint is not observed.

The described model makes it possible to more reliably take into account the behavior of the rolling mill 1, in the transition areas where the force $F_{cone}$ applied by the tapered roller 3 of the model would be too high to be tolerable by the tool.

Figure 7:
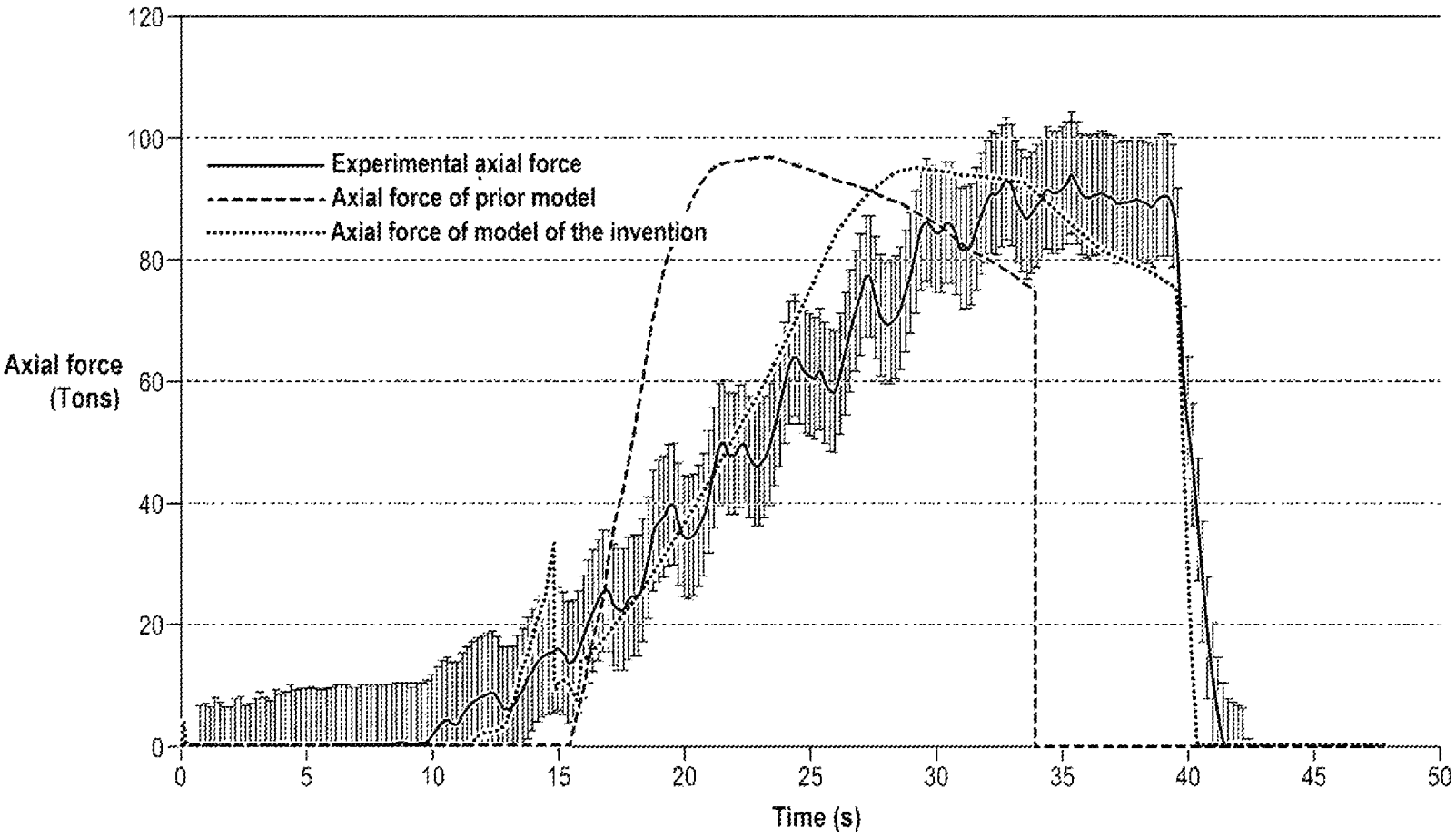
FIG. 7 is a graph representing the variation in the axial force at a tapered roller, computed by a model obtained by a method according to the invention, by a model of the prior art, and measured experimentally.

FIG. 7 illustrates a comparison between the axial force $F_{cone}$ computed by the modeling method proposed, in comparison with a model of the prior art not taking into account this mechanical model, and with experimental force measurements. It can be observed that the proposed modelling method more reliably accounts for the axial force on the tapered roller 3.

During the rolling method, the computed diameter D of the ring 5 will increase to a diameter value that makes the force level change. If the computed value of the force exerted on the tapered roller 3 is less than the new permissible force threshold value, the set of parameters is computed according to the control formula under normal operation.

During the step E3 of the proposed modeling method, the first set of parameters or where applicable the second set of parameters is corrected to obtain a third set of corrected parameters, making it possible to translate the kinetics of all the movable tools of the circular rolling mill 1, and particularly the mandrel 2. The third set of parameters is thus characteristic of the behavior of the circular rolling mill 1 for the given setpoint.

Taking into Account of the Stiffness of the Mandrel 2

To improve the modeling method, it is possible to compute the third set of parameters to take into account the stiffness of the mandrel 2. The control formula as determined during the first step E1 uses a theoretical position of the mandrel 2.

In an exemplary embodiment, the mandrel 2 may be contained in a cage that elastically deforms during the rolling method, which has the consequence of disturbing the position of the mandrel 2. It has been empirically observed that the actual thickness e of the ring 5 is generally greater than the theoretical thickness e. It has been identified that the control unit 10 of the circular rolling mill 1 did not take into account the deformation of the cage of the mandrel 2 in the control during the rolling method.

The elastic deformation of the mandrel cage 2 can be simply modeled as the deformation of a spring attached between the mandrel 2 and the actuator 21 allowing the movement of translation along the second direction X of the mandrel 2.

It can be considered that the cage of the mandrel 2 behaves as a spring of stiffness k, radially exerting a force on the ring 5 depending on the position of the mandrel 2 along the axis of the second direction X. In this exemplary embodiment, the values of the third set of parameters are obtained by adding an offset, positive or negative.

The offset applied as a correction can depend on the radial force computed by the finite element computation code.

In particular, in the example where the set of parameters comprises the speed of increase $\dot{s}$ in the thickness s of the ring 5, which depends directly on the movement of translation of the mandrel 2, the addition of this second mechanical model is relevant since the fact of taking into account the stiffness of the mandrel 2 makes it possible to change the theoretical course of this latter, which is in particular influenced by the virtual deformation of the cage.

Preferably, this second mechanical model can be entirely integrated by Transvalor in the Forge computation code.

Figure 8:
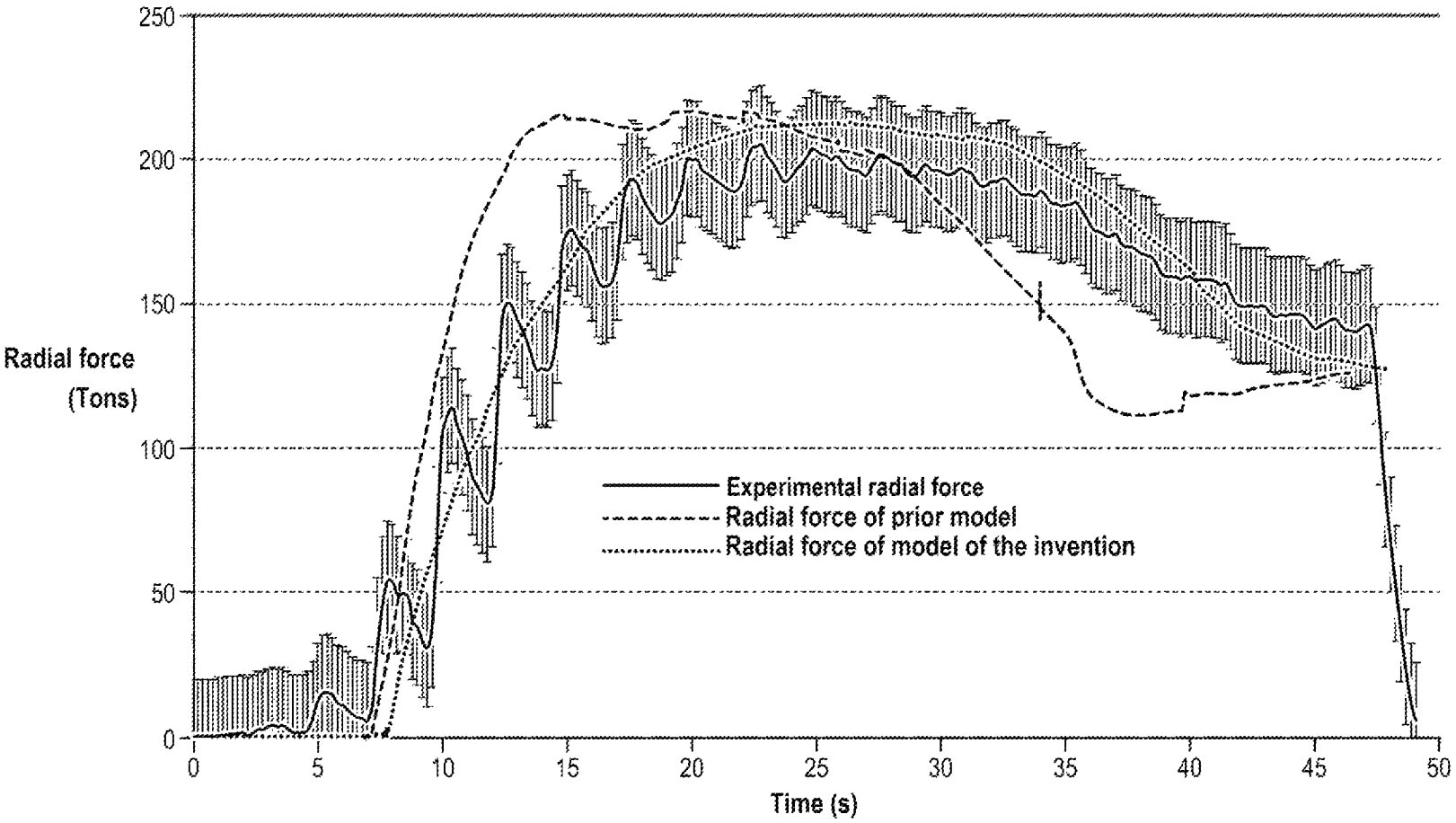
FIG. 8 is a graph representing the variation in the radial force at a mandrel, computed by a model obtained by a method according to the invention, by a model of the prior art, and measured experimentally.

FIG. 8 illustrates a comparison between the radial force computed by the proposed modeling method, by comparison with a model of the prior art not taking into account this second mechanical model, and with experimental force measurements. It has been found that the proposed modeling method more reliably accounts for the radial force on the mandrel 2.

Thus, the method for modeling the behavior of the circular rolling mill 1 as described makes it possible to obtain a complete model making provision for the behavior of the circular rolling installation.

To more fully explain the contribution of the developed model, it is possible to compare the results of the model using a model of the servo-assistance of the roll of thing mill of the prior art and using the new described model, taking into account the two mechanical models expressing the mechanical features of the mandrel 2 and of the tapered roller 3.

Figure 9:
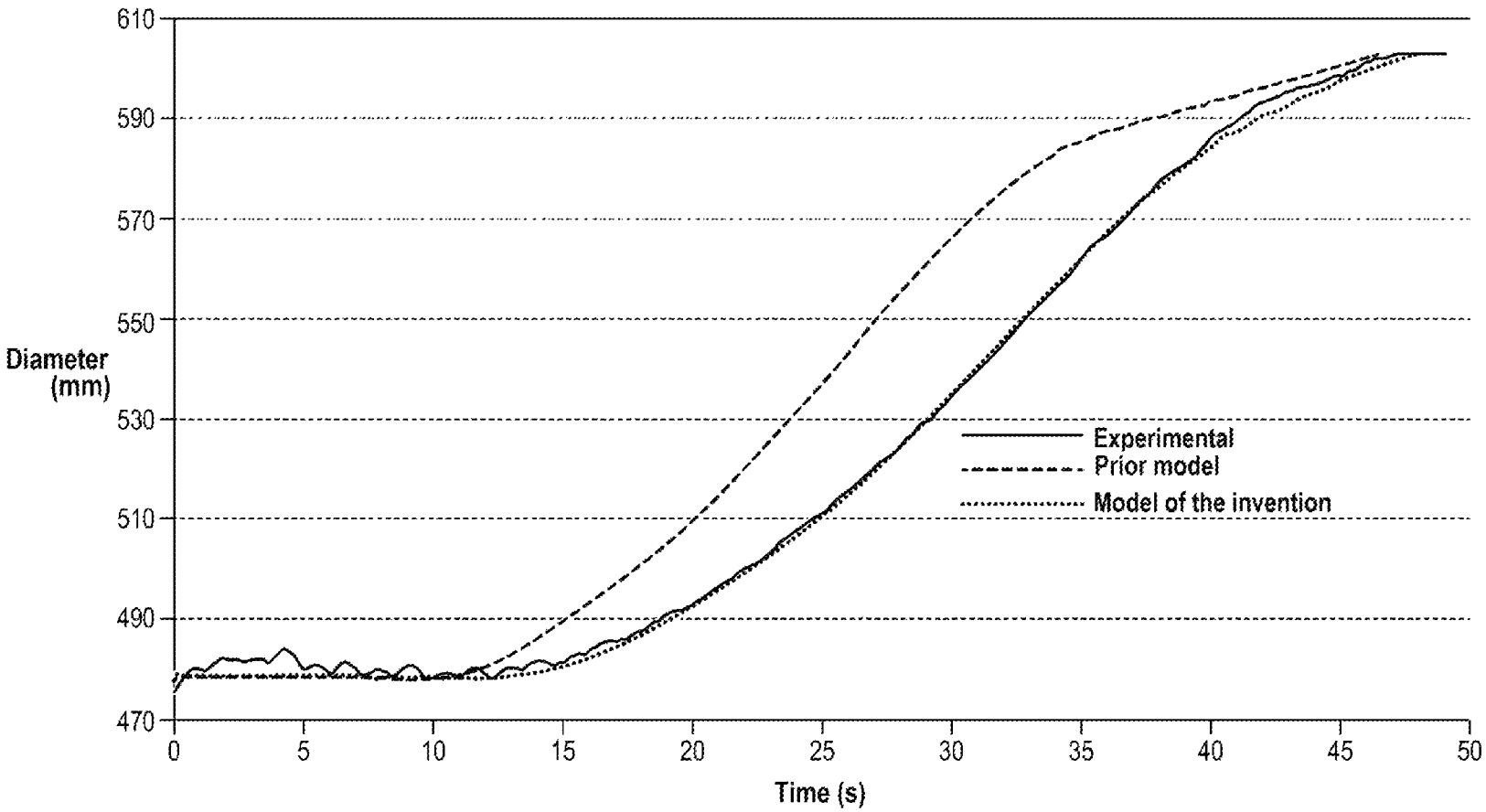
FIG. 9 is a graph representing the variation in the outer diameter of a part during a rolling, computed by a model obtained by a method according to the invention, by a model of the prior art, and measured experimentally.
Figure 10:
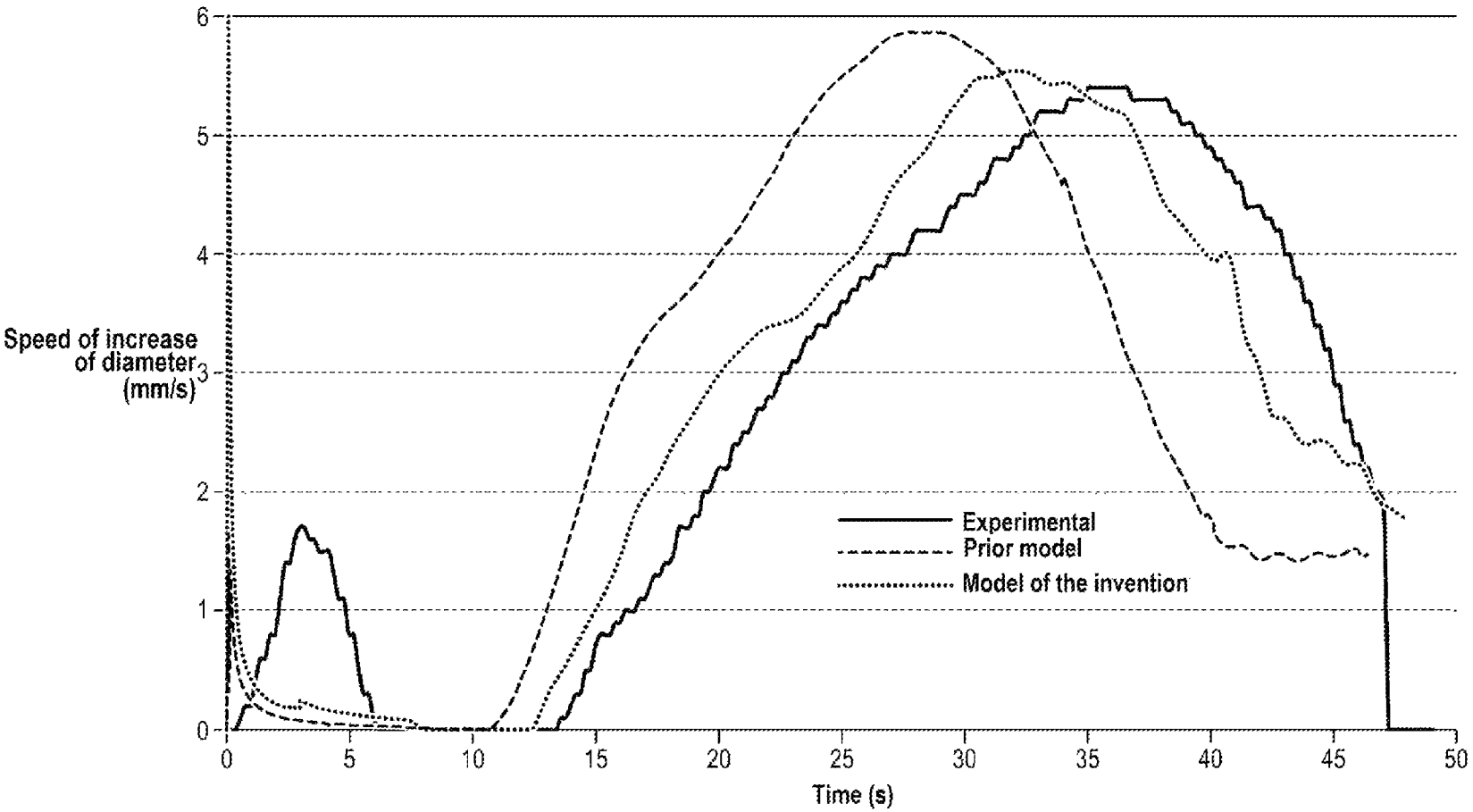
FIG. 10 is a graph representing the variation in the speed of increase of the outer diameter of a part during a rolling, computed by a model obtained by a method according to the invention, by a method of the prior art, and measured experimentally.

FIGS. 9 and 10 illustrate the comparison between the variation in the outer diameter D of the ring 5 and in the speed of increase $\dot{D}$ of the outer diameter of the ring 5, computed by a model of the prior art, by the described model, and obtained by experimental measurements.

It can be seen that the described modeling method makes it possible to obtain a new model that tracks the real variations in the parameters more realistically. Thus, for a setpoint corresponding to a new casting sequence, it is possible to make provision for all the parameters characterizing the variation in the rolling part and the behavior of the rolling mill 1.

In particular it allows for the optimization of the rolling operation without making real parts. It is thus possible to reduce the design costs of casting sequences.

Lastly, owing to the proposed modeling method it is possible to make provision for the duration of the rolling method, which is assumed to be unknown and depends on the part to be rolled. In particular it makes it possible to know whether or not there is a risk of casting the part cold. This control method also makes it possible to limit the risks of scrapping production parts.

The invention claimed is:

1. A method for modeling a behavior of a circular rolling mill, intended to roll a cylindrical part based on a setpoint, the circular rolling mill comprising at least one tapered roller, configured to have a movement of translation along a first direction, and a mandrel, configured to have a movement of translation along a second direction, the setpoint comprising a setpoint of a speed of increase of an outer diameter of the cylindrical part as a function of the outer diameter, and a setpoint for a height of the cylindrical part along the first direction as a function of a thickness of the cylindrical part along the second direction, the method comprising:

obtaining a first set of parameters characteristic of the behavior of the circular rolling mill by a control formula connecting a translation speed of the mandrel along the second direction of translation to the speed of increase of the outer diameter and a function of the setpoint;

performing a finite element computation of a value of a force exerted on the at least one tapered roller based on the first set of parameters;

comparing the computed value of the force exerted on the at least one tapered roller with at least one permissible threshold force value that is permissible by the circular rolling mill, and if the computed value of the force exerted on the at least one tapered roller is greater than the at least one permissible force threshold value, obtaining a second set of parameters, such that the setpoint of the speed of increase of an outer diameter is not observed, correcting the second set of parameters to obtain a third set of parameters; and if the computed value of the force exerted on the at least one tapered roller is less than the at least one permissible force threshold value, correcting the first set of parameters by taking into account a stiffness of the mandrel to obtain the third set of parameters, wherein the third set of parameters are characteristic of the behavior of the circular rolling mill for the setpoint.

2. The method as claimed in claim 1, wherein the first set of parameters obtained by the control formula comprises a speed $\dot{h}$ of a displacement of the at least one tapered roller and the translation speed of the mandrel $\dot{s}$.

3. The method as claimed in claim 1, wherein the control formula is given by:

$$\dot{s} = \frac{s}{D - 2.s + \frac{\dot{h}}{\dot{s}}(D - s).\frac{s}{h}}\dot{D}$$

wherein s is a position of the mandrel, $\dot{s}$ is the speed of translation of the mandrel, $\dot{D}$ is the speed of increase of the outer diameter D of the cylindrical part.

4. The method as claimed in claim 1, wherein, during the comparing, the at least one permissible force threshold value depends on the outer diameter of the cylindrical part.

5. The method as claimed in claim 1, wherein, during the correcting the second set of parameters, a deformation of a cage of the mandrel, modelled as a spring of stiffness constant is taken into account, such that the third set of parameters is obtained by an offset of at least one characteristic parameter of a behavior of the mandrel of the circular rolling mill.

* * * * *